US007691003B2

(12) United States Patent
Munshi

(10) Patent No.: US 7,691,003 B2
(45) Date of Patent: Apr. 6, 2010

(54) PROJECTILE-BASED SPORTS SIMULATION METHOD AND APPARATUS

(76) Inventor: Anees Munshi, 49 Jacana Street, Woodbridge (CA) L4L 4J3

( * ) Notice: Subject to any disclaimer, the term of this patent is extended or adjusted under 35 U.S.C. 154(b) by 1418 days.

(21) Appl. No.: 10/906,035

(22) Filed: Jan. 31, 2005

(65) Prior Publication Data

US 2005/0107179 A1 May 19, 2005

Related U.S. Application Data

(63) Continuation-in-part of application No. 10/895,439, filed on Jul. 24, 2003, now abandoned.

(60) Provisional application No. 60/540,289, filed on Jan. 29, 2004, provisional application No. 60/623,223, filed on Nov. 1, 2004.

(51) Int. Cl.
*A63B 69/36* (2006.01)

(52) U.S. Cl. ..... 473/151; 473/140; 473/190; 473/197; 473/409

(58) Field of Classification Search ..... None
See application file for complete search history.

(56) References Cited

U.S. PATENT DOCUMENTS 4,023,809 A 5/1977 Newton
4,496,156 A 1/1985 Centafanti
5,586,940 A * 12/1996 Dosch et al. ..... 473/140
5,626,526 A 5/1997 Pao et al.
5,997,405 A 12/1999 Russell et al.
6,106,407 A 8/2000 Peyton, Jr.
6,129,637 A 10/2000 Wang et al.
6,257,989 B1 7/2001 Tortola et al.
6,312,345 B1 11/2001 Pelz
6,343,996 B1 2/2002 Gasseling
6,468,167 B1 10/2002 Florian
6,503,150 B1 1/2003 Holmes
6,551,194 B2 4/2003 Hammerquist
6,569,030 B1 5/2003 Hamilton
6,579,189 B2 6/2003 Anzaldua

* cited by examiner

*Primary Examiner*—M. Sager
(74) *Attorney, Agent, or Firm*—Katten Muchin Rosenman LLP

(57) ABSTRACT

A method for performing projectile-based sport simulations. A striking apparatus is used to strike a projectile with striking means, the striking apparatus being configurable to alter its strike properties. The strike results from the strike are measured and are entered into a data base along with the corresponding strike properties. The process is repeated for a variety of strike properties. A sports practice device is then provided having a simulation projectile mounted to a flexible tether and sensor means. The striking apparatus is then used to strike the simulation projectile of the sports practice device using the same strike properties as entered into the database. A user strikes the simulation projectile of the sports practice device and sensor readings are measured. The strike results for the user's strike are calculated by correlating the sensor readings with the information entered into the database.

23 Claims, 6 Drawing Sheets

PROJECTILE-BASED SPORTS SIMULATION METHOD AND APPARATUS

CROSS-REFERENCE

This application is (a) a continuation in part of U.S. patent application Ser. No. 10/895,439 having a filing date of Jul. 24, 2003; (b) a non-provisional of U.S. Patent application No. 60/540,289 filed on Jan. 29, 2004; and (c) a non-provisional of U.S. Patent application No. 60/623,223 filed on Nov. 1, 2004.

FIELD OF THE INVENTION

The invention described herein relates to the field of sports practice devices, and more specifically to the field of projectile-based sports practice devices, as well as to the field of computer input devices, and even more specifically to input devices for computer projectile-based sports simulation, training and play.

BACKGROUND

The aim of many projectile-based sports, such as hockey, soccer, baseball, or golf, is to direct a projectile, such as a ball or puck to a certain target, such as a net or a hole. For many projectile-based sports, the projectile is struck (with a club, bat or even a player's foot) and directed to the target. The more that a player can consistently direct the projectile to the target, the better that player will perform. For this reason, many players would like to practice their game in the comfort of their own home. For the purposes of illustration of the inventions disclosed herein, the game of golf will serve as the focus of discussions. However, it will become clear to the reader that other projectile-based sports are applicable to the present invention.

A system for accurately predicting the flight and roll of a golf ball is of immense value to the golfer, whether beginner or advanced. A number of configurations of golf practice mats have been produced and demonstrated, each with accuracy limitations in predicting the flight of a golf ball, for reasons that will be elaborated below.

The collision between club and ball is a violent event, of duration less than half a millisecond, in which forces of up to 10 kN are imparted by the club-face to the ball. During the impact, the ball deforms significantly, as much as a centimeter, and slides and rolls along the club face, beginning to spin, and finally recoils to depart the club, ending the impact event.

Each individual golf ball's physical properties and the time history of the forces acting upon the ball during the impact completely determine the flight of the ball through the air and its bounce and roll upon landing (assuming a standard atmosphere and ignoring the effects of wind and small-scale random phenomena). Yet, the physics of the impact event, and what happens to the golf ball during it, remain largely intractable due to the large number of variables that must be modeled and their numerical spreads. Empirical collision studies of golf balls against fixed barriers have shown that even the coefficient of restitution of golf balls is a complex, non-linear function of impact speed, angle and force. Ball composition adds another significant variable to the modeling task: while cover softness (the thin dimpled layer surrounding the core) affects the spin-rate acquired by the ball during the collision, the ball's core affects the linear momentum acquired by the ball. When all these variables are put together, small variations in the impact event produce large variations in its outcome. This is what makes the game of golf so hard to master.

The ball's velocity along with spin rate, spin axis and even dimple pattern creates the lifting force, which determines the ball's trajectory.

Upon landing, the ball's forward momentum, which acts to keep the ball rolling, is opposed by the ball's backspin and the coefficient of friction with the course surface (again determined by the cover's stickiness and the dimple pattern). The bounce and roll distance, therefore, is again a function of the ball's construction.

A diagram of the forces at work through impact is shown in FIG. 6. The line S represents the shaft of club 100, and the angle it makes with the face of the club, F X F', is called loft. If the axes, X, Y, and Z, were centered on ball 110 at the first instance of impact, with the Z axis representing the club-head velocity vector at that instant, the ball would be struck with a "lofted, slightly open" club face. The term "lofted" refers to the effective loft angle being greater than the loft of the club, due to the angle between F and Z being obtuse, and the term "slightly open" refers to the fact that the club face is aimed slightly to the right of Z (note that the normal to the face, A, is pointing slightly to the right of Z).

At the moment of contact, with the force vector being parallel to Z, the component of the force normal to the club face, A, begins to compress the ball, while the component of the force tangential to the club face causes the ball to begin sliding and rolling over the club face. The effective loft of the club influences the energy distribution in the departing ball between the linear kinetic energy and the rotational energy it acquires. The lie of the ball also plays a large roll in determining the energy distribution: a ball that is squeezed between the club and the ground at impact will tend to acquire a greater amount of spin, at the cost of linear velocity, while the opposite will be true for the teed ball.

Although FIG. 6 depicts the moment of contact, the collision between a golf club and ball lasts up to about 0.5 seconds, during which time the club and ball stay in contact, traveling together for an inch or less. Through impact, the forces on the ball change in magnitude and direction, thus no single moment in time can be predictive of the ball's flight and roll.

The departing ball's linear and spin kinetic energy components are a complex function of the swinging club's parameters—mass, velocity, deceleration through impact, effective loft angle, etc.—and the ball's parameters—the coefficient of restitution of the ball, which, along with the ball's mass, determines the amount of linear energy transfer, and the effective coefficient of friction which determines the amount of spin energy of the departing ball.

If the spin axis is tilted away from the horizontal, the lift experienced by the ball will also cause it to veer to the left or to the right, causing the weekend golfer's much-dreaded hook and slice, but also the coveted fade and draw that the professional golfer is able to command.

At the moment of landing, the golf ball will have a downward velocity component, a forward velocity component and residual spin. These dynamical parameters of the landing ball, together with its coefficient of restitution, rolling resistance and friction determine its bounce and roll, subject to the topography of the terrain and the type of surface it lands on.

Several means have been proposed in the art for estimating a golf ball's flight based on the acquisition of post-impact ball measurements. In a tethered ball golf practice device, the ball is attached to the mat by some secure means and yet is able to move freely within a constrained volume so that the feel of hitting the captive ball is similar to that of a free ball.

Various arrangements of tethered golf balls for golf practice mats have been proposed in the literature, such as the hung ball, the cantilevered ball (side attachment), and the teed ball. Designers have in some cases attempted to reduce the effect of the tether on the measurements, but have otherwise been unable to compensate for it. In the case of a free ball golf practice device, measurement or estimation of the ball's spin rate and spin axis, a task that is essential to the simulation's accuracy, is prone to large measurement errors because of the difficulty involved.

High-speed stroboscopic photography of specially marked balls is also limited to measuring spin about a single axis. Yet, three-dimensional spin is highly determinative of the golf ball's flight and roll, since spin can generate a lifting force that is greater than the force of gravity; hence errors in estimating the spin rate and axis cause large discrepancies between the predicted and actual ball behavior.

Accordingly, there is a need for an improved system of golf simulation practice devices which compensates for the difficulties encountered with the prior art devices.

SUMMARY OF THE INVENTION

Disclosed herein is a method for performing projectile-based sport simulations. First, a striking apparatus is used to strike a first projectile with striking means, the striking apparatus being configurable to alter the strike properties with which the first projectile is struck. The strike results from the strike are measured, the strike results including the distance over which the first projectile travels. The strike properties and strike results are then entered into a database. The process is repeated for a variety of strike properties. A sports practice device is then provided having a tethered projectile assembly, the tethered projectile assembly comprising a simulation projectile mounted to a flexible tether and sensor means. The sensor means is selected from the group comprising: at least one projectile detection means, the projectile detection means being capable of detecting the position and velocity of at least a portion of the tethered projectile assembly after the simulation projectile is struck; at least one strain gauge mounted in the tethered projectile assembly to detect the deflection thereof; and striking means detection sensors to detect the strike properties of a striking means as it strikes the simulation projectile. The striking apparatus is then used to strike the simulation projectile of the sports practice device using the same strike properties as entered into the database. Sensor readings are measured from the sensor means during the strikes and the sensor readings and the strike properties are entered in the database, such that each set of the sensor readings corresponds to a set of strike properties and such that each set of strike properties corresponds to a set of strike results. A user then strikes the simulation projectile of the sports practice device and sensor readings produced by the sensor means are measured. The strike results for the user's strike are calculated by correlating the sensor readings with the information entered into the database.

In an alternative embodiment, the projectile-based sport is golf, the first projectile is a first golf ball, the simulation projectile is a simulation golf ball and the striking means is a golf club head.

In another embodiment, the strike properties include the speed of the golf club head and the trajectory of swing of the golf club head.

In still another embodiment, the strike properties further include the face angle of the golf club head as it strikes the first golf ball.

In a further embodiment the strike results further include the angle of trajectory through which the first golf ball travels. The strike results may further include the distance over which the first golf ball travels until it first strikes the ground and the total distance the first golf ball travels.

In a still further embodiment, the method includes the step of displaying the calculated strike results.

The projectile detection means may include a sensor grid, the sensor grid being positioned in the path of the simulation golf ball when the simulation golf ball is struck.

The at least one strain gauge may include a plurality of strain gauges, the plurality of strain gauges being positioned such that the three dimensional deflection of the tethered projectile assembly is measured.

The striking means detection sensors may comprise optical sensors.

In another aspect of this invention, described herein is a system for performing projectile-based sport simulations. The system comprises a sports practice device having a tethered projectile assembly, the tethered projectile assembly comprises a simulation projectile mounted to a flexible tether and a sensor means. The sensor means is selected from the group comprising: at least one projectile detection means, the projectile detection means being capable of detecting the position and velocity of at least a portion of the tethered projectile assembly after the simulation projectile is struck; at least one strain gauge mounted in the tethered projectile assembly to detect the deflection thereof; and striking means detection sensors to detect the strike properties of a striking means as it strikes the simulation projectile. The system also includes a database of sensor readings correlated to strike results and a computer having software adapted to receive readings from the sensor means and correlate the reading with the strike results. The system also includes a display means operatively connected to the computer for displaying the results of the correlation.

In an alternative embodiment, the projectile-based sport is golf, and the simulation projectile is a simulation golf ball.

In a further alternative, the strike results further include the angle of trajectory through which the first golf ball travels. The strike results may further include the distance over which the first golf ball travels until it first strikes the ground and the total distance the first golf ball travels.

Another aspect of the present invention is a projectile-based sport practice device having a simulation projectile mounted to a first end of a flexible tether and a base to which the second end of the flexible tether is mounted. A plurality of strain gauges measures the deflection of the tether during a strike of the simulation projectile, the strain gauges being adapted to measure the deflection of the flexible tether in three dimensions. Control circuitry records and analyzes the strain gauge measurements.

In an alternative embodiment, the projectile-based sport is golf, and the simulation projectile is a simulation golf ball.

A further aspect of the present invention is a projectile-based practice device having a substantially flat practice surface and a flexible longitudinal tether having a first end attached to a simulation projectile and a second end attached to a fixed position on the practice surface. When the simulation projectile is struck, the simulation projectile will tend to rotate through a projectile path about the fixed position. A net is mounted proximate to the projectile path such that when the simulation projectile travels through the projectile path after being struck, the net will be drawn into the projectile path by the Bernoulli effect and impede the motion of the projectile.

In an alternative embodiment, the projectile-based sport is golf, and the simulation projectile is a simulation golf ball.

The fixed position may be a pivot base and the second end of the tether may be affixed to a pivot head where the pivot head is rotatably mounted to the pivot base.

Optionally, the pivot head is removably mounted to the pivot base.

Another aspect of the present invention is a method for using projectile based sport practice devices with projectile-based sport computer games, wherein the computer games are completely controllable using human input device signals from at least one human input device selected from the group comprising: mouse, trackball, keyboard and joystick. A sports practice device having a tethered projectile assembly is provided, the tethered projectile assembly comprising a simulation projectile mounted to a flexible tether and a sensor means. The sensor means is selected from the group comprising: at least one projectile detection means, the projectile detection means being capable of detecting the position and velocity of at least a portion of the tethered projectile assembly after the simulation projectile is struck; at least one strain gauge mounted in the tethered projectile assembly to detect the deflection thereof; and striking means detection sensors to detect the strike properties of a striking means as it strikes the simulation projectile. The sensor readings from a strike of the simulation projectile are taken and corresponding free-projectile strike results are obtained by correlating the sensor readings with free-projectile strike results from a prepared database. The free-projectile strike results are then converted to equivalent human input device signals and the signals are sent to the computer game.

In an alternative embodiment the projectile-based sport is golf, and the simulation projectile is a simulation golf ball.

BRIEF DESCRIPTION OF THE FIGURES

The novel features which are believed to be characteristic of the present invention, as to its structure, organization, use and method of operation, together with further objectives and advantages thereof, will be better understood from the following drawings in which presently preferred embodiment(s) of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION

The novel features which are believed to be characteristic of the present invention, as to its structure, organization, use and method of operation, together with further objectives and advantages thereof, will be better understood from the following discussion in combination with the accompanying drawings.

Figure 1:
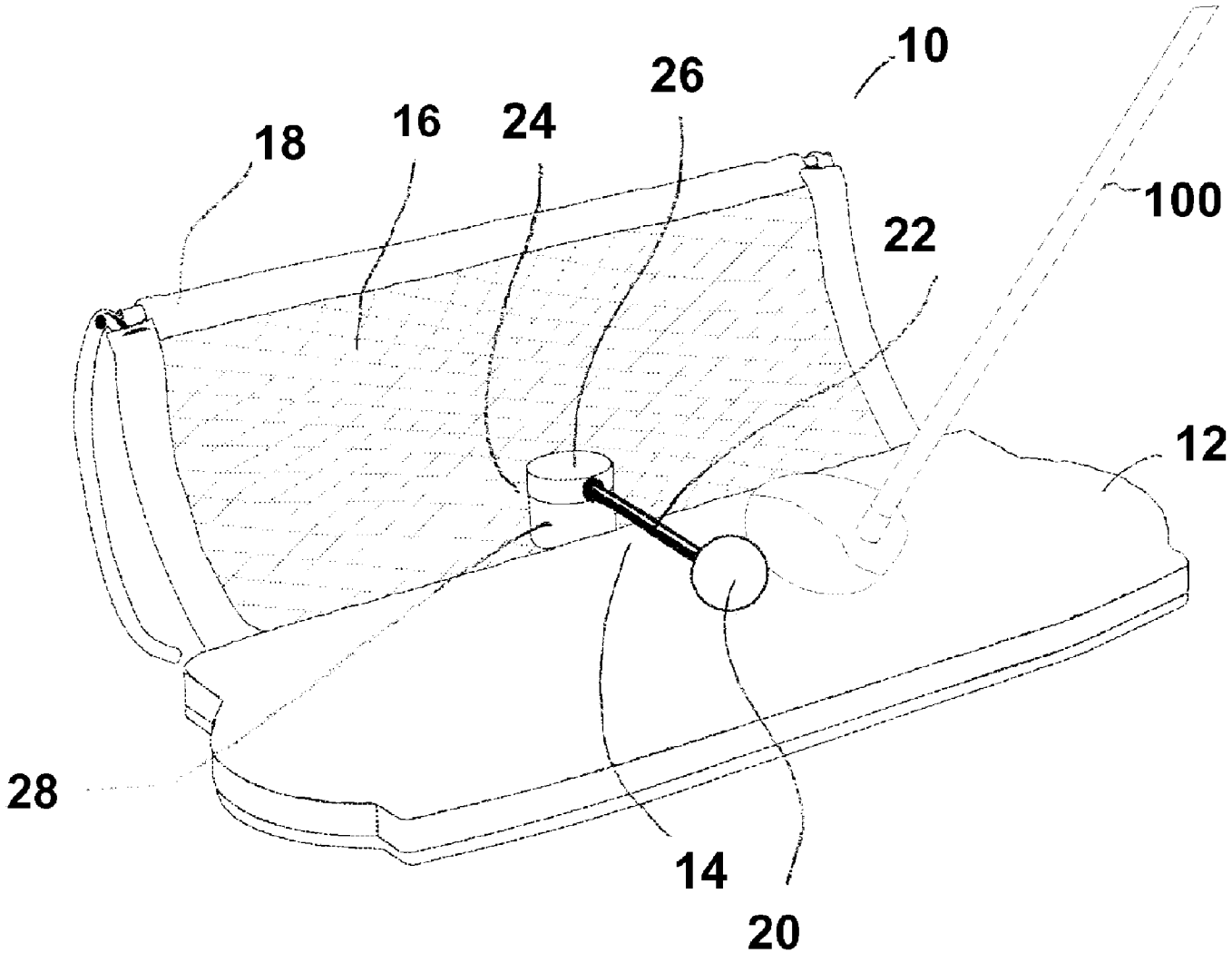
FIG. 1 is a perspective view a first embodiment of a golf practice device in accordance with the present invention.

FIG. 1 shows a sports practice device in the nature of golf practice mat 10 in accordance with the present invention. Golf practice mat 10 includes a flat surface in the nature of turf portion 12, a tethered projectile assembly 14 and a net 16 mounted in a net frame 18. Tethered projectile assembly 14 includes a simulation projectile in the nature of a golf ball 20, a tether 22 to which golf ball 20 is attached at a first end of said tether, and a pivot mount 24 to which the second end of tether 16 is attached. Pivot mount 24 is preferably attached to turf portion 12.

Golf ball 20 is preferably the same size and construction as a standard golf ball. Golf ball 20 is preferably attached to tether 22 in such manner that neither tether 22 nor pivot mount 24 hinder the movement of a club after impacting with the ball.

Preferably, tether 22 is made from a highly flexible, memoryless material which allows a significant deflection from even low velocity shots, such as chipping and putting shots. Tether 22 is sufficiently flexible to permit deflection in all three dimensions, as well as permit some ball rotation through torsion of the tether.

The inertia exhibited by ball 20 together with tether 22 and pivot mount 24 is designed to be equal to the inertia of a free, regulation golf ball, so that the dynamic feel of the ball at impact is the same as that of a free, regulation golf ball. Preferably, the mass of golf ball 20 is adjusted to compensate for the mass and inertia of tether 22 and pivot mount 24 so that the inertia of the tethered ball arrangement, complete with the inertia of the moving parts of pivot mount 24, is equal to the inertia of a free, regulation golf ball.

Pivot mount 24 preferably comprises a two piece system: a pivot head 26 to which the tether is affixed and a pivot base 28 about which the pivot head rotates. Pivot head 26 is preferably rotatably mounted with respect to pivot base 28 using ball-bearings or a similar low-friction arrangement so that the motion of the ball during the brief period of impact resembles that of a free ball, providing a similar sound and feel to the club as a free-ball impact. In a preferred embodiment of the invention a double ball-bearing pivot mount is used to provide free rotation of the pivot. Preferably, pivot head 26 may be easily removed from pivot base 28. This allows the user to easily replace tethered projectile assembly 14 when golf ball 20 or other portions of the assembly become worn. In addition, when the user removes pivot head 26, the golf practice mat 10 may be used with a free ball.

Net 16 may be mounted near the rotational projectile path of golf ball 20, such that net 16 depletes the energy from golf ball 20 noiselessly, thus not distracting the user from the sound of the club-ball impact. Net 16 is mounted with sufficient slack within frame 18 so that the slack net is drawn to the moving ball by means of the Bernoulli Effect, thus noiselessly retarding the motion of the tethered-ball apparatus through friction.

The optional use of net 20 of reduces wear, through unnecessary impact by an undamped tethered ball, on the various parts of the device. As well, should golf ball 20 become detached from tether 22 during rotation, net 16 may prevent golf ball 20 (which is spinning at high speeds) from causing damage to the surroundings or injury to nearby persons. In addition, net 16 reduces the number of rotations made by golf ball 20 about pivot mount 24. The reduction in rotations removes some of the visual distraction which may detract from the simulation experience.

A tethered tee (not shown) may be provided which can be placed under the ball to optionally raise it off the hitting surface. The tee is anchored to the mat in such a way as to remain with the device after being struck by the club, without unduly obstructing the path of the club. In the preferred embodiment of the invention, a lightweight, rubber tee is anchored to the unit by means of a lightweight, strong and flexible cord, in such a way that when not being used, the tee may be set aside without interfering with the movement of either the club or the ball.

Sensors

There are three main forms of sensor means that may be used with golf practice mat 10. One form of sensor measures the deflection of the tether after the ball is struck. Another form of sensor is a projectile detection means which measures the position and velocity of the ball after it is struck. The third form of sensor is a striking means detection sensor which measures the speed and position of the striking means as it strikes the ball. The sensors pass their readings to a control circuit.

Figure 2:
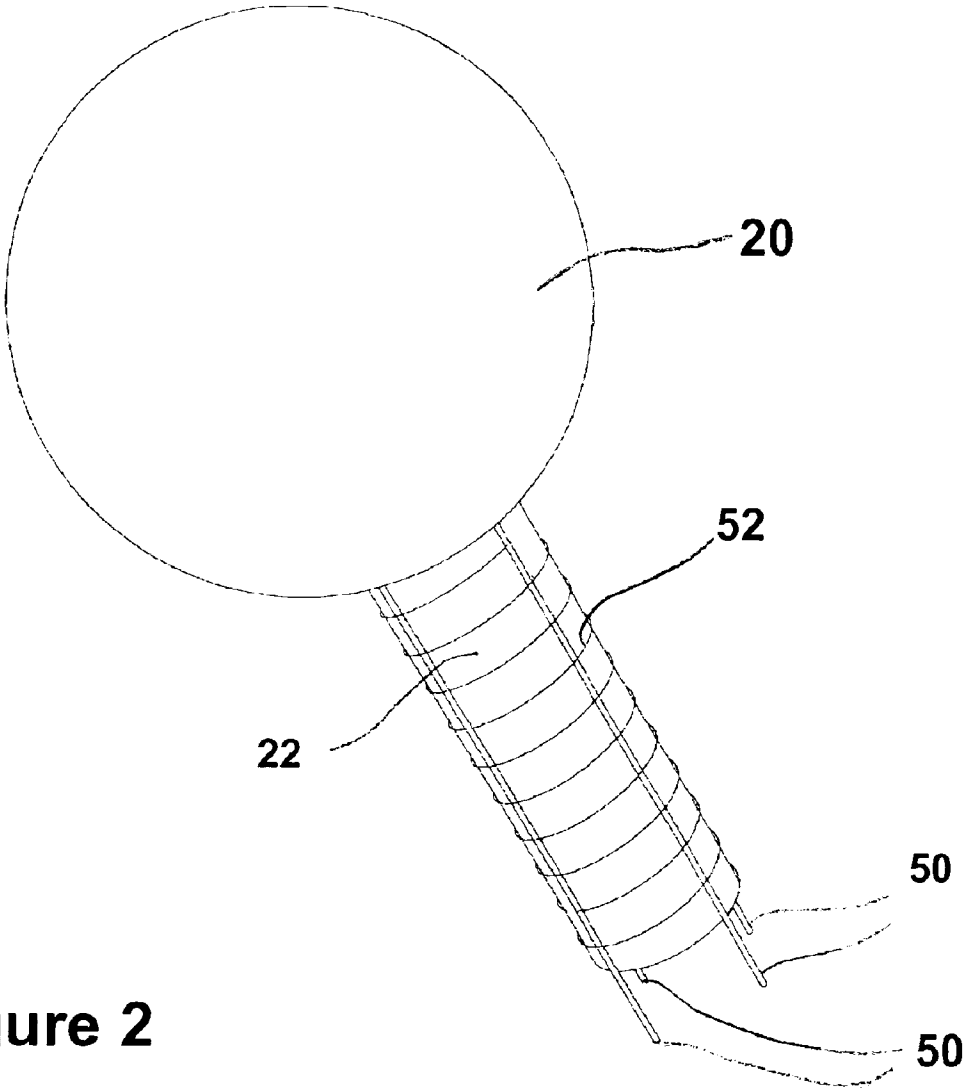
FIG. 2 shows a tethered golf ball from the golf practice device of FIG. 1.
Figure 3:
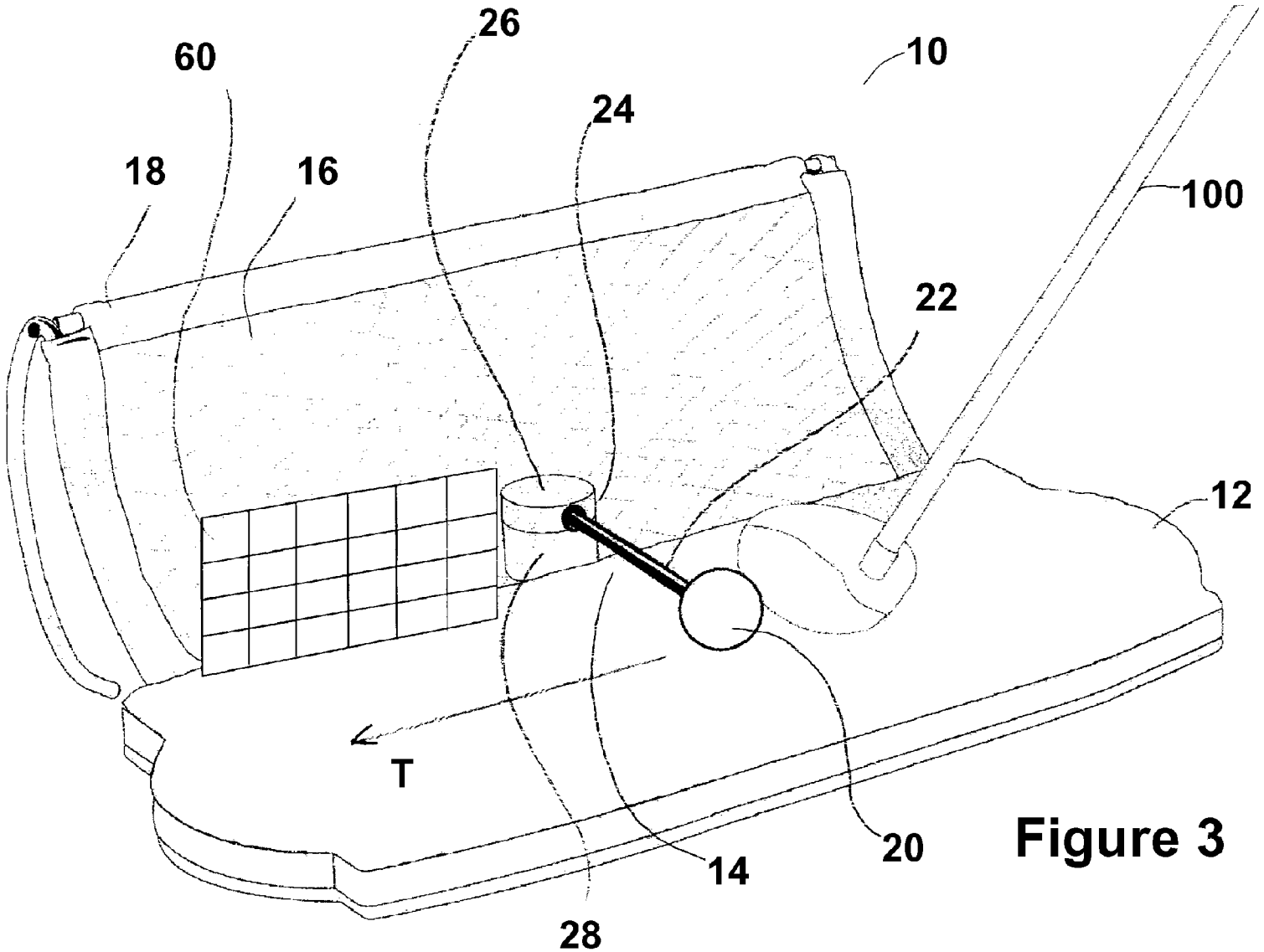
FIG. 3 is a perspective view of an alternative embodiment of the golf practice device of FIG. 1.

The first form of sensor is shown in more detail in FIG. 2. A set of five strain gauges are mounted to tether 22. Four axial strain gauges 50 are positioned such that they run parallel to the central longitudinal axis of tether 22. Preferably, axial strain gauges 50 are mounted equidistant from one another as shown in FIG. 3. A helical strain gauge 52 is mounted around the outer wall of tether 22 as shown.

Strain gauges 50 and 52 are attached to circuitry (not shown), including analog-to-digital converters, such that the linearity, signal-to-noise ratio and resolution, together with the bandwidth and sampling rate of the whole arrangement is such that a one-to-one relationship exists between the movement of the struck tethered ball, the corresponding deflection of the tether, and the data vector generated therefrom.

The length of the data vector shall include the entire impact event and as much post-impact data as necessary to estimate, using the means described below, the ball's flight and roll were it not tethered. The data vector specifies the deflection and torsion of the tether due to the impact with the club.

An example of the second form of sensor is shown at FIG. 3. One or more sensor grids 60 are placed in the path of the moving ball. Sensor grid 60 records at the moment of intersection with the ball (i) the velocity of the ball, (ii) the grid intersection coordinate and the (iii) time of the intersection.

The ball is struck from a known, well-defined point in space, (such as directly off the mat, or raised by a tee) along target line T. The starting point of the ball is either measured by the system or is one of a set of marked positions selected by the user and inputted to the system.

Tether 22 permits the ball 20 to deflect out of the way of the striking club so as to minimally affect the feel of the shot. The flexibility of tether 22 allows a significant deflection from even low velocity shots, such as putting and chipping shots.

Tether 22 or a part of the tether arrangement may undergo significant extension under the centripetal force of the moving ball, so that higher velocity shots cause a larger extension of the tether arrangement and thus a distinction in the point of intersection with the grids relative to lower velocity shots with the same initial trajectory. This property permits the system to differentiate between shots directed to the left or right of target line T.

Preferably, the tethered ball shall be allowed to rotate (spin) relatively freely about the longitudinal axis of tether 22 so that aerodynamic effects of spin are observed during the short, tethered flight of ball 20. The spin may be accommodated through the torsional flexibility of tether 22.

Sensor grid 60 may use a conventional sensor technology such as optical, sonar, proximity detection, pressure-sensitive membranes, or any other that provides a sufficiently accurate reading of velocity and position at the moment of intersection.

Preferably, sensor grid 60 is made up of an array of vibration sensors (such as piezo-electric transducers) mounted on a rigid substrate, such that by triangulating the signals produced by these transducers, the position, velocity and time of impact is determined.

Preferably, multiple grids may be provided to increase the accuracy of the measurement. Where multiple sensor grids are provided, one or more grids may bounce the ball so that the effect of the ball's spin is amplified. For instance, a secondary grid may be placed under turf 12 and the material making up the surface of turf 12 be chosen to amplify the affect of the spin on the ball such that its landing position on the mat after striking sensor grid 60 is appreciably affected by the spin on ball 20. Sensor grid 60 may be extended to accommodate left-handed users, or a separate grid may be provided for this purpose.

The data vector obtained from sensor grid 60 shall include the velocity, position and time readings from all the sensors. The sensors are connected to data acquisition circuits of sufficient resolution to extract the impact data from the sensors for further processing as described below.

Figure 4:
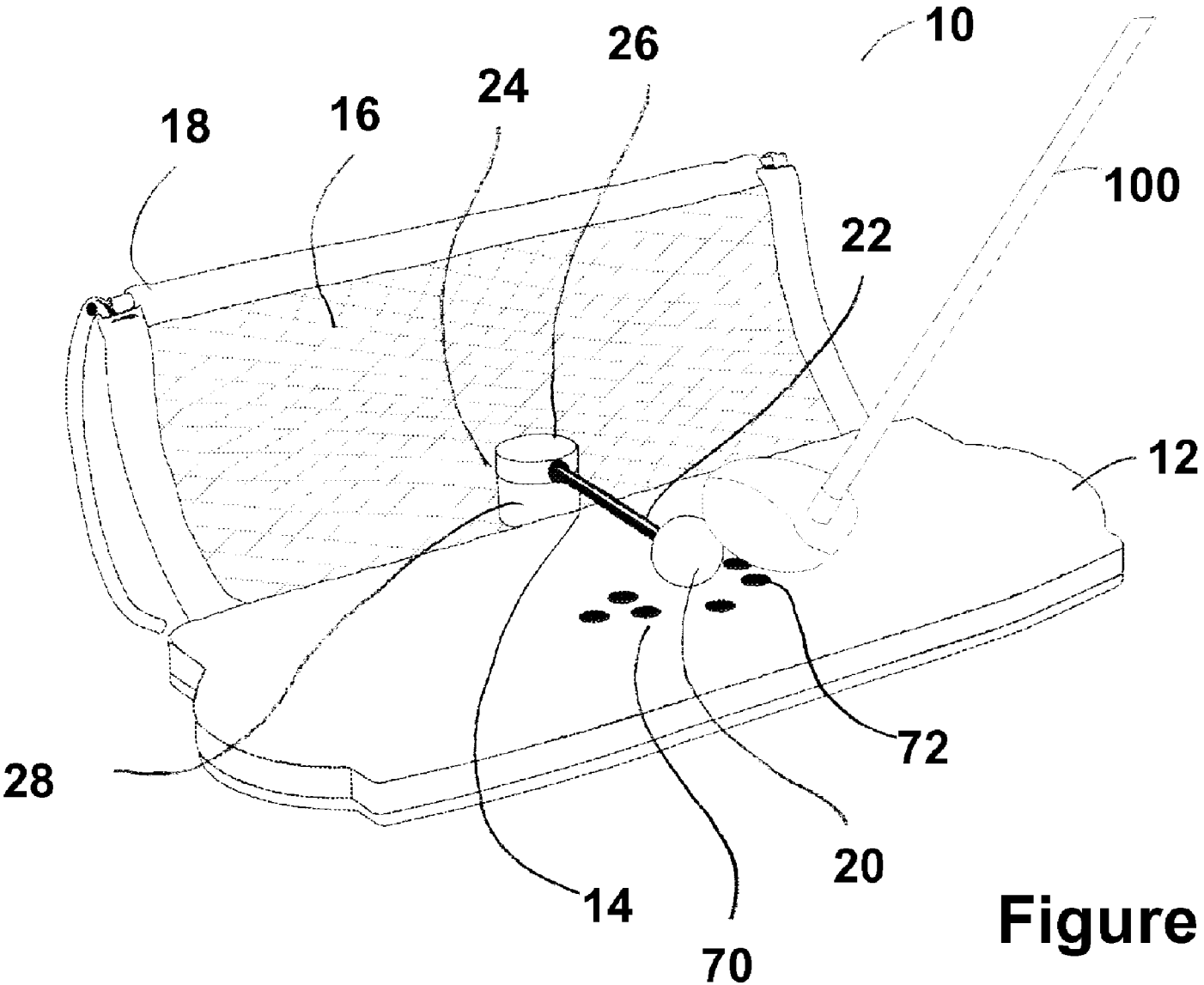
FIG. 4 is a perspective view of another alternative embodiment of the golf practice device of FIG. 1.
Figure 5:
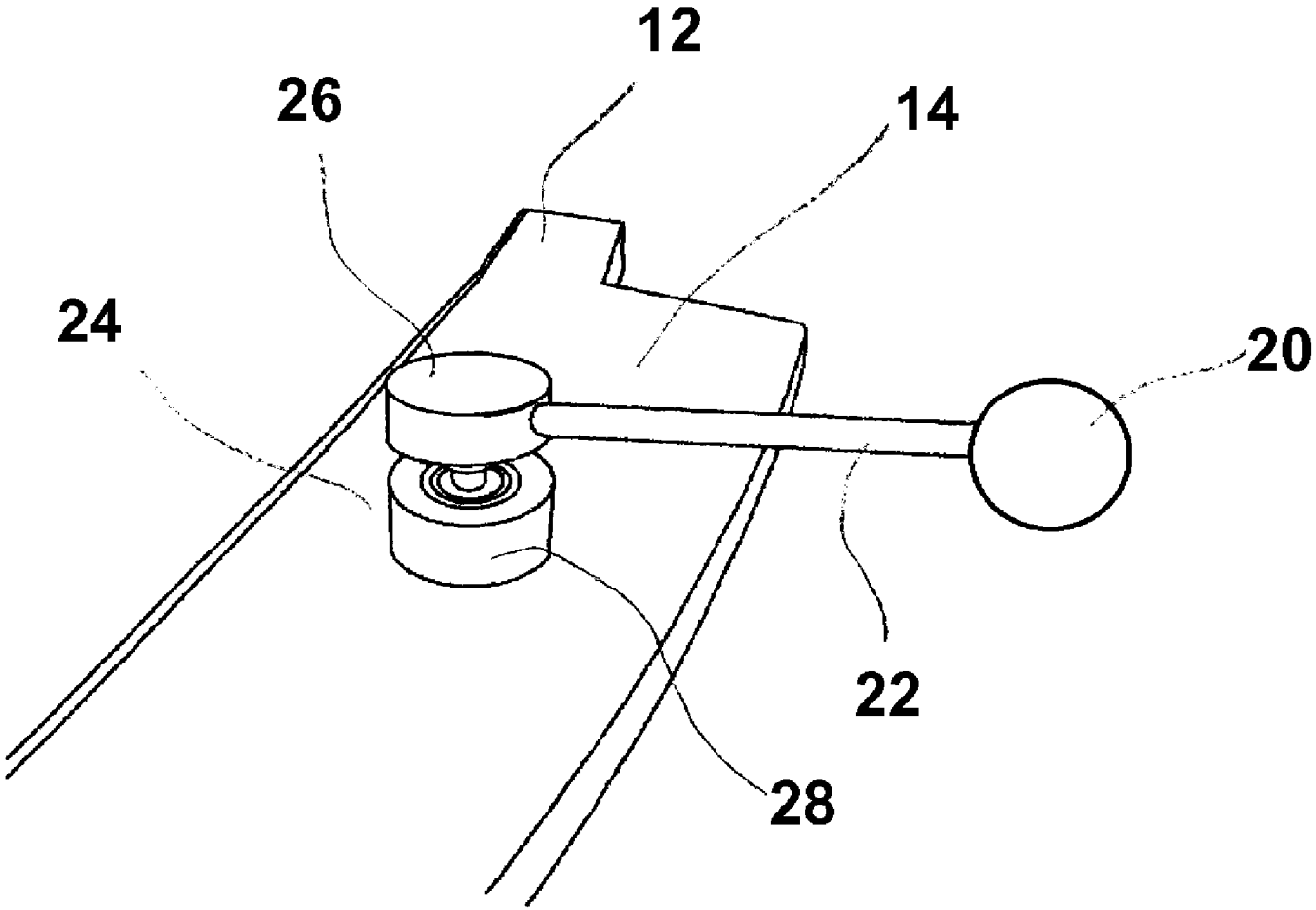
FIG. 5 is a perspective view of a detailed view of the pivot mount of FIG. 4.
Figure 6:
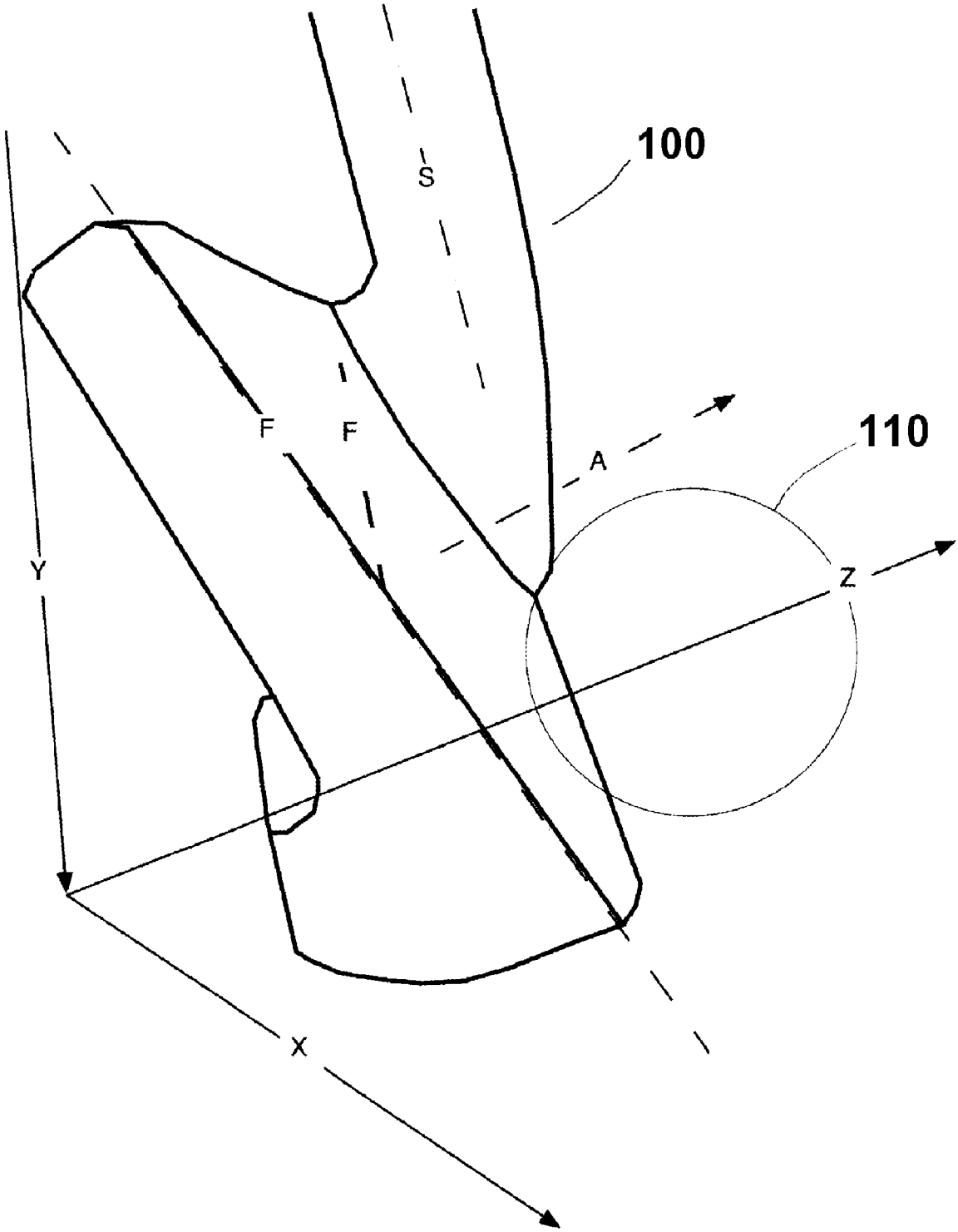
FIG. 6 is a perspective view of a golf club striking a golf ball.

An example of the third form of sensor is shown in FIG. 4. A sensor grid 70 is embedded in the mat so as to measure the path of the club immediately prior to and after the impact with the ball. Sensor grid 70 preferably consists of infra-red optical sensors 72 that detect the position of the golf club by reflecting infrared light off the sole of the club. The output of the sensors is sampled or digitized by an embedded computer to perform the mapping computations as described below. Other forms of striking means detection sensors include visible light sensors, inductive loop sensors and Hall-effect sensors.

Calculating the Trajectory

There are two main methods of determining the ball's flight from the data generated. The first is theoretical while the second is empirical.

In the theoretical method, the readings from the sensor means are used to calculate the velocity, trajectory and spin of golf ball 20. This information is used to calculate the distance over which the ball will travel.

Creating the Database

In the empirical method, a database of golf shots is generated. A striking apparatus or mechanical ball-striking mechanism, such as a golf-playing robot, is used to strike a golf ball with a striking means such as a golf club. The golf-playing robot can be set to use various strike properties such as club selections, lies, orientations, swing paths, and swing velocities. (A description of the ball-striking mechanism is beyond the scope of this invention.) The initial settings (e.g. club type, speed and face angle) are set and the robot is used to strike a regulation ball. It is desirable to set the initial settings to correspond to typical real-world strikes, including mishits.

A variety of strike results can be obtained from the operation. For example, the distance and position of the ball at the point of first contact with the ground after the strike and at its final rest position may be measured. The angle of trajectory of the ball may also be measured. These strike results (or free-projectile strike results) are recorded and entered into the database along with the corresponding strike properties. The process is repeated for different configurations of strike properties. Preferably, the robot is used at an indoor driving range to prevent any wind from affecting the measurements. Optionally, the process may be repeated for different target surfaces (to obtain different roll distances) and different golf balls.

The golf playing robot is then used to strike golf ball 20 mounted to tether 22 on mat 10 with the same settings as used on the free ball. The sensor readings obtained from the sensor means (such as strain gauge readings, sensor grid measurements of ball position and velocity, or optical sensor readings of club position at the strike point) are also entered into the database.

The database of shot data is described as a collection of mappings, with each mapping being the data record: $z_i \Leftrightarrow \xi_i$, where the $z_i$ are the measured data-vectors and the $\xi_i$ are the associated free-ball measurements for the corresponding untethered ball shots.

When a user strikes golf ball 20, the sensor readings obtained from the sensor means are passed to the control circuitry. Generally speaking, the control circuitry correlates the sensor readings with equivalent sensor readings in the database to determine equivalent free-ball strikes. More specifically, a mathematical estimation operation is performed in the control circuitry to map the data-stream from a user's strike of the tethered golf ball 20 (obtained from the sensors) to the flight and roll of an un-tethered regulation golf ball. A mathematical operation known as a projection may be used to find the record in the database that most closely matches the measured strike data, to estimate the ball flight parameters therefrom.

The projection may be computed by minimizing the normed error between the strike-data measured from the user's shot and the strike-data recorded in the database. A least-squares minimization is one such form of minimization. Specifically, the measured strike data-stream, d, shall be projected onto the database by computing v using the equation $v = d \perp \{z_i \Leftrightarrow \xi_i\}$ where $\|d-v\| \leqq \|d-z_i\|$ for all i. The variable v is either a member of the set $\{z_i\}$ or is a linear combination of two or more members of the set $\{z_i\}$. The residual error in $\|d-v\|$ may be further projected on to the database in an iterative operation to refine the estimation of the expected free-ball flight and roll.

It is possible for the mapping operation to produce not only the carry and roll distances, but also the flight trajectory and any other information recorded in the database.

Displaying the Results

Control circuitry as described above may also be connected to a display means for displaying the derived shot information. There are many methods of displaying the shot information, ranging from simple displays to sophisticated simulations.

One method of displaying the shot information is to have a digital readout showing the distance the ball would have traveled and the angle that the ball would have traveled with respect to the intended direction.

In a more complex method of displaying the information, the control circuitry performs the standard mapping and calculation of shot distance and angle. The control circuitry is connected to a computer or game console operating a standard computer golf game via a standard input port for human interface devices (such as a USB or serial port). Standard computer golf games typically use a series of mouse, trackball, keyboard or joystick clicks and motions to set the club path, angle and club speed. The golf game then performs a simulation of the shot on a simulated course.

The control circuitry performs a further mapping operation by mapping the free-ball strike results (as calculated from the comparison of the sensor readings to the database of shots) to the combination of human input device signals equivalent to the mouse, trackball, keyboard or joystick clicks and motions that would generate that shot in the software. The control circuitry sends the signals corresponding to the calculated mouse clicks and motions to the computer and the computer game displays the resulting shot.

It will be obvious to those skilled in the art that the methods, apparatus and systems described herein may be applicable to other sports simulations. For example, a simulation hockey puck or soccer ball could be attached to a tether and the same mapping calculations could be performed.

Other variations of the above principles will be apparent to those who are knowledgeable in the field of the invention, and such variations are considered to be within the scope of the present invention. Other modifications and/or alterations may be used in the design and/or manufacture of the apparatus of the present invention, without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially perpendicular is intended to mean perpendicular, nearly perpendicular and/or exhibiting characteristics associated with perpendicularity.

What is claimed is:

1. A method for performing projectile-based sport simulations comprising:

(a) causing a striking apparatus to strike a first projectile with striking means, said striking apparatus being configurable to alter the strike properties with which said first projectile is struck;

(b) measuring the strike results from said strike, said strike results including the distance over which said first projectile travels;

(c) entering the strike properties and strike results in a database;

(d) repeating steps (a) through (c) for a variety of strike properties;

(e) providing a sports practice device having a tethered projectile assembly, said tethered projectile assembly comprising a simulation projectile mounted to a flexible tether and a sensor means selected from the group comprising:

i. at least one projectile detection means, said projectile detection means being capable of detecting the position and velocity of at least a portion of said tethered projectile assembly after said simulation projectile is struck;

ii. at least one strain gauge mounted in said tethered projectile assembly to detect the deflection thereof; and iii. striking means detection sensors to detect the strike properties of a striking means as it strikes said simulation projectile;

(f) causing said striking apparatus to strike said simulation projectile of said sports practice device using the same strike properties as used in steps (a) through (d);

(g) measuring sensor readings from said sensor means during said strikes;

(h) entering said sensor readings and said strike properties in said database, such that each set of said sensor readings corresponds to a set of strike properties and such that each set of strike properties corresponds to a set of strike results;

(i) having a user strike said simulation projectile of said sports practice device and measuring sensor readings produced by said sensor means; and (j) calculating the strike results for the user's strike in step (i) by correlating the sensor readings obtained in step (i) with the information entered into the database.

2. A method as claimed in claim 1, wherein said projectile-based sport is golf, said first projectile is a first golf ball, said simulation projectile is a simulation golf ball and said striking means is a golf club head.

3. A method as claimed in claim 2, wherein said strike properties include the speed of the golf club head and the trajectory of swing of said golf club head.

4. A method as claimed in claim 3, wherein said strike properties further include the face angle of said golf club head as it strikes said first golf ball.

5. A method as claimed in claim 2, wherein said strike results further include the angle of trajectory through which said first golf ball travels.

6. A method as claimed in claim 5, wherein said strike results further include the distance over which said first golf ball travels until it first strikes the ground and the total distance said first golf ball travels.

7. A method as claimed in claim 2, further comprising the step of displaying the calculated strike results.

8. A method as claimed in claim 2, wherein said projectile detection means includes a sensor grid, said sensor grid being positioned in the path of said simulation golf ball when said simulation golf ball is struck.

9. A method as claimed in claim 2, wherein said at least one strain gauge includes a plurality of strain gauges, said plurality of strain gauges being positioned such that the three dimensional deflection of said tethered projectile assembly is measured.

10. A method as claimed in claim 2, wherein said striking means detection sensors comprise optical sensors.

11. A system for performing projectile-based sport simulations, said system comprising:

(a) a sports practice device having a tethered projectile assembly, said tethered projectile assembly comprising a simulation projectile mounted to a flexible tether and a sensor means selected from the group comprising:
   i. at least one projectile detection means, said projectile detection means being capable of detecting the position and velocity of at least a portion of said tethered projectile assembly after said simulation projectile is struck;
   ii. at least one strain gauge mounted in said tethered projectile assembly to detect the deflection thereof; and
   iii. striking means detection sensors to detect the strike properties of a striking means as it strikes said simulation projectile;
(b) a database of sensor readings correlated to strike results;
(c) a computer having software adapted to receive readings from said sensor means and correlate said reading with said strike results; and
(d) a display means operatively connected to said computer for displaying the results of said correlation.

12. A system as claimed in claim 11, wherein said projectile-based sport is golf, and said simulation projectile is a simulation golf ball.

13. A system as claimed in claim 12, wherein said strike results further include the angle of trajectory through which said first golf ball travels.

14. A system as claimed in claim 13, wherein said strike results further include the distance over which said first golf ball travels until it first strikes the ground and the total distance said first golf ball travels.

15. A system as claimed in claim 12, wherein said projectile detection means includes a sensor grid, said sensor grid being positioned in the path of said simulation golf ball when said simulation golf ball is struck.

16. A system as claimed in claim 12, wherein said at least one strain gauge includes a plurality of strain gauges, said plurality of strain gauges being positioned such that the three dimensional deflection of said tethered projectile assembly is measured.

17. A system as claimed in claim 12, wherein said striking means detection sensors comprise optical sensors.

18. A projectile-based practice device comprising:

(a) a substantially flat practice surface;
(b) a flexible longitudinal tether having a first end attached to a simulation projectile and a second end attached to a fixed position on said practice surface, such that when said simulation projectile is struck, said simulation projectile will tend to rotate through a projectile path about said fixed position;
(c) a net mounted proximate to said projectile path such that when said simulation projectile travels through said projectile path after being struck, said net will be drawn into the projectile path by the Bernoulli effect and impede the motion of said simulation projectile.

19. A device as claimed in claim 18, wherein said projectile-based sport is golf, and said simulation projectile is a simulation golf ball.

20. A device as claimed in claim 19, where said fixed position is a pivot based and said second end of said tether is affixed to a pivot head, said pivot head being rotatably mounted to said pivot base.

21. A device as claimed in claim 20, wherein said pivot head is further removably mounted to said pivot base.

22. A method for using projectile-based sport practice devices with projectile-based sport computer games, wherein said computer games are completely controllable using human input device signals from at least one human input device selected from the group comprising: mouse, trackball, keyboard and joystick; said method comprising the steps of:

(a) providing a sports practice device having a tethered projectile assembly, said tethered projectile assembly comprising a simulation projectile mounted to a flexible tether and a sensor means selected from the group comprising:
   i. at least one projectile detection means, said projectile detection means being capable of detecting the position and velocity of at least a portion of said tethered projectile assembly after said simulation projectile is struck;
   ii. at least one strain gauge mounted in said tethered projectile assembly to detect the deflection thereof; and
   iii. striking means detection sensors to detect the strike properties of a striking means as it strikes said simulation projectile;
(b) obtaining sensor readings from a strike of said simulation projectile;
(c) obtaining equivalent free-projectile strike results from said strike by correlating said sensor readings with free-projectile strike results from a prepared database;
(d) converting said free-projectile strike results to equivalent human input device signals; and
(e) sending said signals to said computer game.

23. A method as claimed in claim 22, wherein said projectile-based sport is golf, and said simulation projectile is a simulation golf ball.

* * * * *